United States Patent [19]

Leneveu et al.

[11] 4,326,901

[45] * Apr. 27, 1982

[54] FRAGMENTABLE CHARGES OF PROPELLAND POWDER COATED WITH POLYVINYL NITRATE, AND THE PROCESS FOR THEIR MANUFACTURE

[75] Inventors: Louis Leneveu; Didier Treneules, both of Chateaulin, France

[73] Assignee: Societe Nationale des Poudres et Explosifs, Paris, France

[ * ] Notice: The portion of the term of this patent subsequent to Jul. 21, 1998, has been disclaimed.

[21] Appl. No.: 72,583

[22] Filed: Sep. 5, 1979

[30] Foreign Application Priority Data

Sep. 21, 1978 [FR] France ..... 78 27118

[51] Int. Cl.[3] ..... C06B 45/24; C06B 21/00

[52] U.S. Cl. ..... 149/12; 149/2; 149/19.91; 149/19.92; 264/3 R; 264/3 B

[58] Field of Search ..... 149/19.8, 19.92, 19.93, 149/19.91, 12, 2; 264/3 R

[56] References Cited

U.S. PATENT DOCUMENTS

| | | | |
|---|---|---|---|
| 3,711,343 | 1/1973 | Dunigan et al. | 149/19.8 |
| 4,023,996 | 5/1977 | Leneveu | 149/19.8 |
| 4,202,713 | 5/1980 | Ragon et al. | 149/19.1 |
| 4,214,927 | 7/1980 | Inoue et al. | 149/19.8 |

FOREIGN PATENT DOCUMENTS

| | | | |
|---|---|---|---|
| 2968 | 7/1979 | European Pat. Off. | 149/19.8 |
| 2361879 | 6/1974 | Fed. Rep. of Germany | 149/19.8 |

*Primary Examiner*—Edward A. Miller

*Attorney, Agent, or Firm*—Bucknam and Archer

[57] ABSTRACT

The present invention relates to a new type of fragmentable charge for weapons of small and medium caliber.

The process for the manufacture of fragmentable charges of propellant powder containing nitrocellulose, according to the invention, is characterized in that, in a conventional process for the manufacture of propellant powder containing nitrocellulose, with solvent, a glazing operation is carried out, in which a glazing solution containing at least polyvinyl nitrate and a stabilizer is sprayed onto the grains of powder, and in that, after evaporation of the solvent from the said solution, the grains of powder thus obtained are compressed at between about 80° and 120°.

The invention also relates to the fragmentable charges obtained by means of this process.

13 Claims, No Drawings

FRAGMENTABLE CHARGES OF PROPELLAND POWDER COATED WITH POLYVINYL NITRATE, AND THE PROCESS FOR THEIR MANUFACTURE

The present invention relates to a new type of fragmentable charge for weapons of small and medium calibre, which charge is produced from grains of propellant powder containing nitrocellulose, which are coated with a film based on polyvinyl nitrate.

The use of fragmentable charges based on grains of propellant powder, in ammunition for weapons of small and medium calibre, is becoming increasingly common because these charges make it possible to use, in a given volume, a larger amount of energy-producing material than that which is possible in the case of a loose charge of grains of propellant powder, whilst retaining, by virtue of the fragmentation on ignition, the essential combustion characteristics of loose charges, in particular the rapid rise in pressure in the breech of the weapon.

There are two major methods for the manufacture of fragmentable charges from grains of propellant powder.

The first method consists in ensuring the cohesion of the grains of powder by means of a chemical binder. This chemical binder can be either a crosslinkable polymer, such as, for example, a polyurethane, or an oil which gelatinises nitrocellulose, such as nitroglycerine. Nevertheless, this first method is far from satisfactory from the point of view of the manufacturers of fragmentable charges. In fact, it is not easy to use a polyurethane binder because of the difficulty involved in weighing an exact amount of pasty polymer, and the slightest deviation in weight leads to a variation in the ballistic performances obtained with the final block; furthermore, this type of fragmentable charge has exhibited a poor dimensional stability in the event of large temperature variations. On the other hand, the use of gelatinising oil, such as nitroglycerine, necessitates all the precautionary measures associated with the use of explosive nitrated oil, and it is moreover known that these oils tend to exude with time, thereby modifying the performances of the charge, not to mention the dangers presented by the presence of droplets of nitroglycerine on the surface of the charge.

The second method for the manufacture of fragmentable charges from grains of propellant powder consists in ensuring the cohesion of the grains of powder by means of hot compression. This method makes it possible to obtain charges which are much more homogeneous from the point of view of their chemical composition, and which therefore possess a greater homogeneity and a greater reliability from the point of view of the ballistic results. Nevertheless, this method is difficult to carry out because nitrocellulose does not possess a softening point and it is not possible to ensure the cohesion of uncoated grains of powder by means of compression, even under the action of heat. For the purpose of rendering this operation less dangerous, it has already been proposed either to treat the grains of propellant powder, before compression, with a liquid plasticiser which gelatinises nitrocellulose, such as, for example, triacetin, or to mix the grains of powder, before compression, with a thermosplastic solid binder based on nitrocellulose and on polyvinyl nitrate. These solutions make it possible to carry out the compression of the grains of powder under safer conditions, but they complicate the process for the manufacture of the fragmentable charge by the fact that, on the one hand, it is necessary to ensure the impregnation of all the grains of powder by means of a liquid plasticiser, and, on the other hand, it is necessary to ensure that the mixing of two solids is as homogeneous as possible.

The object of the present invention is to propose a simple process for the manufacture of homogeneous fragmentable charges from grains of propellant powder containing nitrocellulose, which are coated with a layer of polyvinyl nitrate.

The process for the manufacture of fragmentable charges of propellant powder containing nitrocellulose, according to the invention, is characterised in that, in a conventional process for the manufacture of propellant powder containing nitrocellulose, with solvent, a glazing operation is carried out, in which a glazing solution containing at least polyvinyl nitrate and a stabiliser is sprayed onto the grains of powder, and in that, after evaporation of the solvent from the said solution, the grains of powder thus obtained are compressed at between about 80° and 120° C. The invention also relates to the fragmentable charges obtained by means of this process.

The process according to the invention therefore makes it possible, by the use of a particular glazing solution, to obtain, by means of a conventional process for the manufacture of a propellant powder based on nitrocellulose, with solvent, grains of powder which can be directly compressed, without additional handling and at temperatures which are substantially lower than the decomposition point of nitrocellulose, to give fragmentable charges which are perfectly homogeneous because they have been obtained from grains of powder which are all identical.

Conventionally, propellant powders containing nitrocellulose are manufactured by malaxating nitrocellulose, in the presence of customary additives known to those skilled in the art, in a gelatinising solvent which is generally an ether/ethyl alcohol mixture. The paste thus obtained is extruded as strands, chopped into grains, drained in air and soaked in water so as to completely remove the solvents. The grains of powder are then dried. They can then be subjected to the so-called glazing operation, in which, in a conventional process, a combustion moderator, for example camphor or a urea such as centralite, in solution in a solvent, is sprayed onto the grains of powder. The grains of powder are then optionally soaked again and dried, in general in order to undergo a final graphitisation.

According to the invention, the glazing operation is therefore modified and consists in spraying, onto the grains of propellant powder containing nitrocellulose, a solution of polyvinyl nitrate mixed with a stabiliser which is preferably diphenylamine or 2-nitrodiphenylamine. The solvent used is either an aliphatic ketone/aliphatic alcohol mixture, such as an acetone/ethyl alcohol mixture, or a lower aliphatic ester/aliphatic alcohol mixture, such as an ethyl acetate/ethyl alcohol mixture. The preferred mixture according to the invention is an acetone/ethyl alcohol mixture. The weight ratio of ketone or ester/powder can be between 0.20 and 0.40 and is preferably between 0.25 and 0.35. The weight ratio of alcohol/powder can be between 0.05 and 0.30 and is preferably between 0.15 and 0.25. It can be advantageous to add, to the polyvinyl nitrate and the stabiliser, a plasticiser chosen from amongst the customary plasticisers known to those skilled in the art, such as dibutyl phthalate, dioctyl phthalate, dinitrotoluene, camphor and diethyldiphenylurea. According to a particular embodiment of the invention, nitrocellulose can also be added to the polyvinyl nitrate. All these combinations are possible provided that the amount of polyvinyl nitrate present in the glazing solution is between 2 and 10%, preferably between 3 and 5%, of the weight of powder to be treated.

The glazing solution is sprayed onto the powder at a temperature which is approximately between 30° and 50° C. For example, this spraying can be carried out in a coating drum. The solvent is then allowed to evaporate off for about one hour, and grains of propellant powder containing nitrocellulose, which are coated with an external layer rich in polyvinyl nitrate and are ready to be compressed without any further particular handling, are thus obtained.

According to a particular embodiment of the invention, the glazing operation with the solution containing polyvinyl nitrate is carried out after a conventional operation for glazing the powder with a combustion moderator. In this case, it can be advantageous, after the first glazing operation, to soak and dry the grains of powder so as to completely remove the solvents introduced by the first glazing operation.

The grains of powder coated in this way are compressed hot at a temperature of between 80° and 120° C. The pressure used for compression depends on the nature of the base powder and on the expected fragmentation characteristics of the charge. In the case of the customary fragmentable charges intended for ammunition for weapons of small and medium calibre, it is generally sufficient to use a pressure of between 100 and 200 bars for compression. The grains of powder are pre-heated for about ten minutes at the compression temperature, they are compressed and they are allowed to cool in air. The fragmentable charges thus obtained are perfectly homogeneous because they have been obtained exclusively from grains of powder which are all identical. Furthermore, the compression of the grains of powder takes place at a temperature below the decomposition point of nitrocellulose by virtue of the thermoplastic layer of polyvinyl nitrate which coates each grain of powder.

The invention will be understood more clearly with the aid of the embodiment given below.

EXAMPLE

Fragmentable charges were produced from a simple-based powder containing nitrocellulose, possessing a potential energy of 900 calories/gram. The powder had been chopped into cylindrical grains possessing a single central hole, with a 0.4 mm web. In a first stage, this powder was glazed with 2% of centralite. The powder was then glazed in a coating drum with a collodion, based on polyvinyl nitrate, having the following composition (per 100 g of powder):

polyvinyl nitrate: 3 g
acetone: 30 g
ethyl alcohol: 10 g
2-nitrodiphenylamine: 0.03 g The temperature of the coating drum was 40° C. The coating drum was allowed to rotate, with the door open, for one hour.

The grains of powder thus obtained were compressed to give cylindrical blocks possessing a central channel. The mould is pre-heated to 90° C. The powder coated in this way is introduced into the mould, the temperature of the powder is allowed to rise for 3 to 4 minutes, the powder is compressed for one minute under a pressure of 150 bars and the block is immediately withdrawn from the mould and allowed to cool in air. Blocks having a height of 72.6 mm and a diameter of 30 mm were thus manufactured from 70 g of powder. These blocks were fired with or without loose added powder, in 30 mm ammunition, the weight of the shell being 236 g, and gave the following firing results:

| Added powder | $P_M$ in bars | $\sigma P_M$ | $V_{25}$ in m/second | $\sigma V_{25}$ |
|---|---|---|---|---|
| None | 2,700 | 260 | 870 | 21 |
| 0.3 g BTU 85 (0.9) | 3,060 | 287 | 891 | 21 |
| 1 grain B7T 92 (0.9) | 3,500 | 216 | 923 | 13 |
| 2 grains B7T 92 (0.9) | 3,700 | 230 | 937 | 20 |

$P_M$: maximum pressure in the weapon
$V_{25}$: velocity of the shell at 25 meters from the gun
$\sigma$: standard deviation
BTU 85 (0.9): grains of simple-based powder containing nitrocellulose, with a single hole, potential energy: 850 cals/g, web: 0.9 mm
B7T 92 (0.9): grains of simple-based powder containing nitrocellulose, with 7 holes, potential energy: 920 cals/g, web: 0.9 mm By way of comparison, the original grains of powder, simply glazed with centralite, were introduced loose into the same ammunition; it was thus possible to introduce 52 g of powder (instead of 70 g in the case of the compressed fragmentable charge), taking account of the volume lost as space. The firing results were as follows:

$P_M$: 2,600 bars
$V_{25}$: 790 m/second.

Considering these results, it is observed that the compressed charges according to the invention fragment and burn in the same way as loose powder charges, producing analogous ballistic results to those produced by the loose charges, but they have a better performance than the latter because they make it possible to introduce a greater amount of energy-producing material into a given volume. Furthermore, the process for their manufacture is very simple and very reliable.

We claim:

1. Process for the manufacture of fragmentable charges from grains of propellant powder containing nitrocellulose comprising (1) malaxating nitrocellulose in a first solvent which has a gelatinizing action for nitrocellulose thus obtaining a paste, (2) extruding the paste to obtain strands, (3) chopping the strands to obtain grains, (4) drying the grains, (5) spraying the grains with a glazing solution containing at least polyvinyl nitrate, a second solvent, and a stabiliser to obtain grains coated with polyvinyl nitrate, (6) evaporating the second solvent and (7) compressing the resulting grains at a temperature of 80° to 120° C. to form said fragmentable charges.

2. Process according to claim 1, wherein the second solvent is a ketone/alcohol mixture.

3. Process according to claim 1, wherein the second solvent is an ester/alcohol mixture.

4. Process according to claim 2, wherein the said ketone/alcohol mixture is an acetone/ethyl alcohol mixture.

5. Process according to claim 3, wherein, the said ester/alcohol mixture is an ethyl acetate/ethyl alcohol mixture.

6. Process according to claim 1, wherein the said glazing solution contains a plasticiser.

7. Process according to claim 1, wherein the said glazing solution contains nitrocellulose.

8. Process according to claim 1, wherein the amount of polyvinyl nitrate in the glazing solution is between 2 and 10% by weight of the powder to be treated.

9. Process according to claim 8, wherein the amount of polyvinyl nitrate is between 3 and 5% by weight of the powder to be treated.

10. Process according to claim 1, wherein said compressing is carried out at a pressure of between 100 and 200 bars.

11. The process according to claim 1 wherein said spraying with a glazing solution is carried out at a temperature of 30° to 50° C.

12. The process according to claim 1 wherein said first solvent is a mixture of an ether and ethyl alcohol.

13. Fragmentable charges based on grains of propellant powder containing nitrocellulose, prepared by (1) malaxating nitrocellulose in a first solvent which has a gelatinizing action for nitrocellulose thus obtaining a paste, (2) extruding the paste to obtain strands, (3) chopping the strands to obtain grains, (4) drying the grains, (5) spraying the grains with a glazing solution containing at least polyvinyl nitrate, a second solvent and a stabilizer to obtain grains coated with polyvinyl nitrate, (6) evaporating the second solvent and (7) compressing the resulting grains at a temperature of 80° to 120° C. to form said fragmentable charges.

* * * * *